United States Patent [19]

Honda et al.

[11] Patent Number: 4,985,734

[45] Date of Patent: Jan. 15, 1991

[54] WASTE TONER COLLECTING CONTAINER PROVIDED WITH CORONA CHARGER

[75] Inventors: Iwakazu Honda; Yuhi Yui, both of Nara, Japan

[73] Assignee: Sharp Kabushiki Kaisha, Osaka, Japan

[21] Appl. No.: 353,492

[22] Filed: May 18, 1989

[30] Foreign Application Priority Data

May 20, 1988 [JP] Japan ..... 63-124199

[51] Int. Cl.[5] ..... G03G 21/00

[52] U.S. Cl. ..... 355/298; 355/260

[58] Field of Search ..... 355/200, 210, 215, 245, 355/260, 296, 298

[56] References Cited

U.S. PATENT DOCUMENTS

| | | | |
|---|---|---|---|
| 4,140,389 | 2/1979 | Franke et al. | 355/297 |
| 4,660,962 | 4/1987 | Maekawa et al. | 355/303 |
| 4,711,561 | 12/1987 | Tsuruoka | 355/298 |
| 4,757,344 | 7/1988 | Idenawa et al. | 355/260 |

FOREIGN PATENT DOCUMENTS

| | | | |
|---|---|---|---|
| 0228062 | 8/1987 | European Pat. Off. . | |
| 3716365 | 11/1987 | Fed. Rep. of Germany . | |
| 60-107077 | 6/1985 | Japan . | |
| 60-198574 | 10/1985 | Japan . | |
| 60-254072 | 12/1985 | Japan | 355/298 |
| 62-108275 | 5/1987 | Japan | 355/298 |
| 62-222271 | 9/1987 | Japan . | |
| 62-286071 | 12/1987 | Japan . | |
| 63-10424 | 3/1988 | Japan . | |

*Primary Examiner*—Fred L. Braun

[57] ABSTRACT

A waste toner collection container equipped with a corona charger for use in an electrophotographic arrangement, which includes a waste toner collecting box (11*a*) for accommodating residual toner scraped off a photosensitive surface of a photosensitive member (10) after transfer, and a corona charger adapted to charge the photosensitive surface of the photosensitive member (10) after charge erasing of the photosensitive surface, with the corona charger being provided on the waste toner collecting box (11*a*).

6 Claims, 2 Drawing Sheets

WASTE TONER COLLECTING CONTAINER PROVIDED WITH CORONA CHARGER

BACKGROUND OF THE INVENTION

The present invention generally relates to a collecting container, and more particularly, to a waste toner collecting container provided with a corona charger for use in an electrophotographic arrangement of an electrostatic transfer type, etc, and having a function for accommodating waste toner after transfer, and also a function for charging a photosensitive member.

Generally, in a laser printer or the like which is an electrophotographic apparatus of an electrostatic transfer type, etc., it is so arranged that, after uniformly charging the photosensitive surface of a photosensitive member in a drum shape (referred to as a photoreceptor drum hereinafter), laser light from a semi-conductor laser unit or the like is irradiated onto the photosensitive surface so as to form an electrostatic latent image on said photosensitive surface. Toner for a developing material is caused to adhere onto the latent image by a developing device provided in the vicinity of the photoreceptor drum so as to form a visible toner image, which is subsequently transferred onto a copy paper sheet fed to a transfer station. Residual toner adhering onto the surface of the photoreceptor drum is scraped off by a cleaning blade or the like into the waste toner collecting container.

Incidentally, the photoreceptor drum, corona charger and developing material as referred to above are expendables. They are required to be replaced periodically.

Similarly, with respect to the waste toner collecting container, it is also necessary to periodically exchange or to take out the waste toner therefrom for maintaining the container in a condition to receive waste toner at all times.

However, in order to exchange the photoreceptor drum, corona charger, developing material, and waste toner collecting container, etc., individually, much time and labor are required therefor.

Accordingly, an arrangement capable of exchanging the corona charger upon replacement of a photoreceptor drum or another arrangement in which the items required to be exchanged such as the photoreceptor drum, corona charger, developing material, and waste toner collecting container, etc. are incorporated into one cartridge so that they can be replaced simultaneously have been proposed.

In the conventional construction as described above, however, before it becomes necessary to replace the photoreceptor drum, developing material or the like whose life has been prolonged recently, toner scattering in air tends to adhere to a charger line of the corona charger, thus undesirably giving rise to irregularity or variation in the charger output with respect to the photoreceptor. Therefore, it has been required to periodically clean the charger line by an exclusive cleaning item. Inconveniences such as breakage or deformation of the charger line, etc. tend to take place during the cleaning.

SUMMARY OF THE INVENTION

Accordingly, an essential object of the present invention is to provide a waste toner collecting container equipped with a corona charger, which is so arranged that the corona charger for charging the photosensitive member after charge erasing is provided on a waste toner collecting box for accommodating waste toner scraped off the surface of the photosensitive member after transfer, with substantial elimination of disadvantages inherent in the conventional arrangement of this kind.

Another object of the present invention is to provide a waste toner collecting container of the above described type which is simple in construction and stable in functioning at high reliability.

In accomplishing these and other objects, according to one preferred embodiment of the present invention, there is provided a waste toner collecting container for use in an electrophtographic arrangement, which includes a waste toner collecting box extending over a length generally the same as a lateral width of a photoreceptor drum and open at its side confronting the photosensitive surface of the photoreceptor drum, a charger case provided adjacent to said open side of the waste toner collecting box and similarly open at its side confronting the photosensitive surface of said photoreceptor drum, and a corona charger line disposed within the charger case.

By the arrangement of the present invention as described above, the replacement of the waste toner collecting container becomes necessary before irregularity or variation is undesirably produced in the charger output with respect to the photosensitive surface due to adhesion of toner scattering in air onto the charger line of the corona charger, and thus, the corona charger can be replaced together with the waste toner collecting box. Accordingly, it becomes unnecessary to periodically clean the charger line by an exclusive cleaning item, and consequently, the possibility of giving rise to such troubles as breakage or deformation of the charger line during cleaning, etc. may be advantageously eliminated.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

These and other objects and features of the present invention will become apparent from the following description taken in conjunction with the preferred embodiment thereof with reference to the accompanying drawings, which are given by way of illustration only, and thus are not limitative of the present invention, and in which;

FIG. 1(*b*) is a fragmentary rear side view of the waste toner collecting container of FIG. 1(*a*);

FIG. 1(*c*) is a fragmentary perspective view at the rear side portion of the waste toner collecting container of FIG. 1(*a*) particularly showing, on an enlarged scale, fitting portions thereof with respect to an electrophotographic arrangement.

DETAILED DESCRIPTION OF THE INVENTION

Figure 1A:
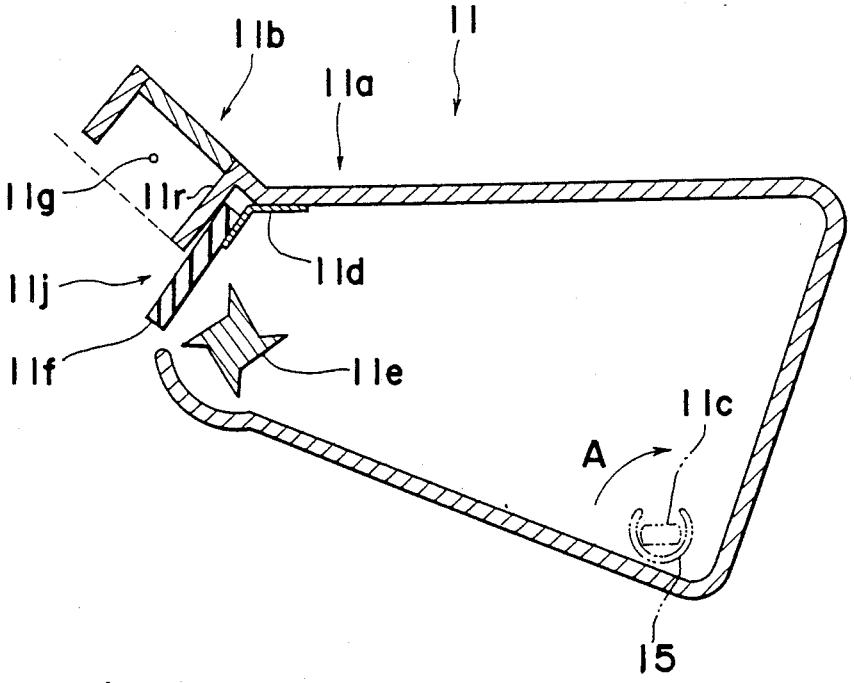
FIG. 1(*a*) is a side sectional view of waste toner collecting container provided with a corona charger according to one preferred embodiment of the present invention.

Before the description of the present invention proceeds, it is to be noted that like parts are designated by like reference numerals throughout the accompanying drawings.

Figure 2:
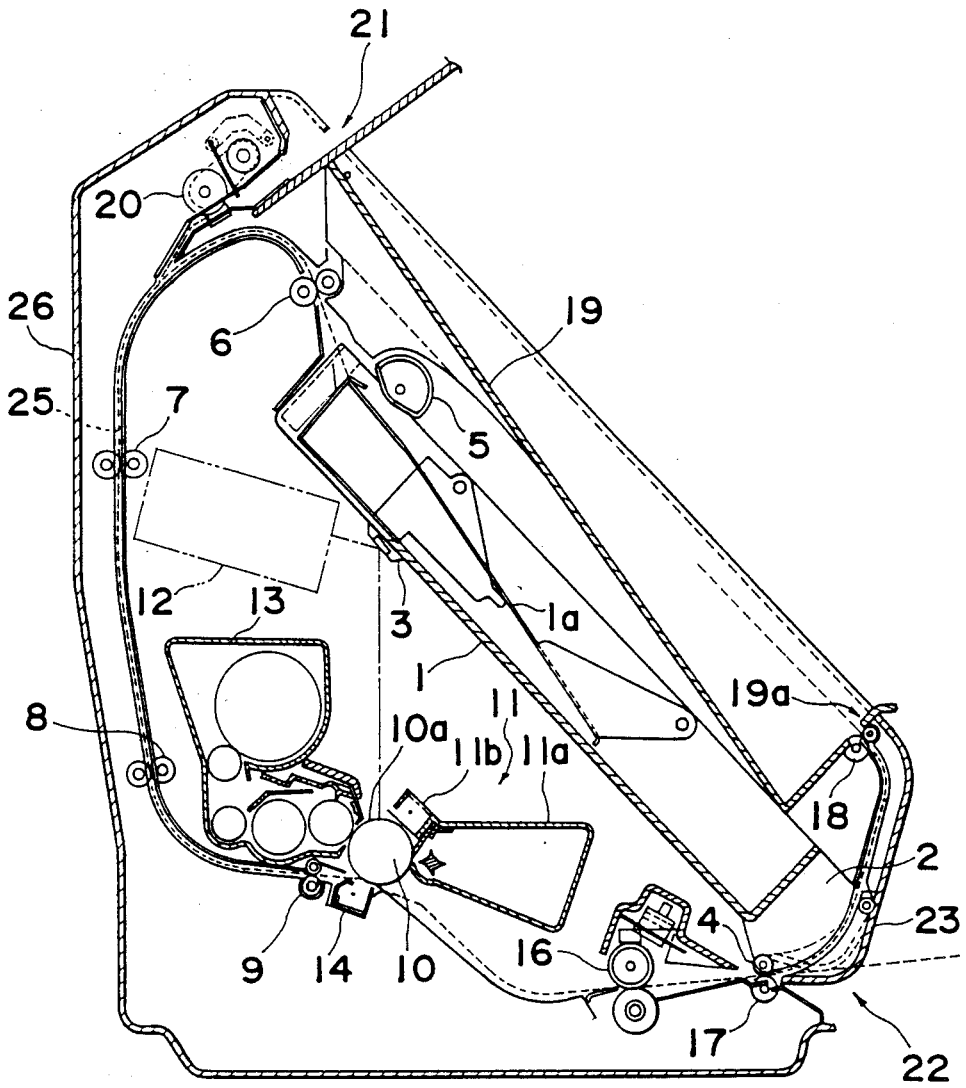
FIG. 2 a schematic side sectional view of a laser printer to which the waste toner collecting container according to the present invention may be applied.

Referring now to the drawings, FIG. 2 shows a laser printer to which a waste toner collecting container according to the present invention may be applied. The laser printer generally includes a housing 26 with a cross section in approximately a triangular configuration, a manual paper feeding section 21 having a feeding roller 20 provided at an upper portion of the housing 26, a face-down tray 19 provided under the manual paper feeding section 21 along an inclined face of the housing 26 for accommodating paper sheets discharged after printing, with a face-down paper receiving port 19*a* being provided in a lower side wall of the face-down tray 19, and a paper feeding cassette 1 for accommodating paper sheets, mounted on the back wall of the face-down tray 19, at an inclination angle approximately in the same degree as that for the face-down tray 19, with an introducing roller 5 and a feeding roller 6 being provided at the upper portion of the paper feeding cassette 1 as illustrated.

A paper transport passage 25 for connecting the paper feeding side of the cassette 1 with the face-down paper receiving port 19*a* is formed through the back side of the paper feeding cassette 1. At the lower end side of the paper feeding cassette 1, there is provided a guide wall member 2 which forms one part at one side of the paper transport passage 25, while at the lower end portion of said guide wall member 2, a roller 4 constituting one of a set of discharge rollers is provided.

Moreover, on a bottom wall of the paper feeding cassette 1, a mirror 3 is mounted, and beside the paper feeding cassette 1 adjacent to its bottom wall, a semiconductor laser unit 12 is provided as shown by two-dotted chain lines. Thus, laser light emitted from the semi-conductor laser unit 12 is arranged to be reflected by the mirror 3 so as to be projected onto the photosensitive surface 10*a* of the photoreceptor drum 10.

Along the paper transport passage 25 from the paper feeding cassette 1 to the face-down tray 19, sets of transport rollers 7, 8, and 9 are provided for transporting the paper sheet fed from the rollers 6 and 20 towards the photoreceptor drum 10.

Meanwhile, around the photoreceptor drum 10, waste toner collecting container 11 equipped with a corona charger for charging the photosensitive surface 10*a* of the photoreceptor drum 10, a developing device 13 for developing an electrostatic latent image formed on the photosensitive surface 10*a* of the photoreceptor drum 10 into a visible toner image, and a transfer charger 14 for transferring the toner image thus developed onto a paper sheet are sequentially disposed as shown.

Figure 1B:
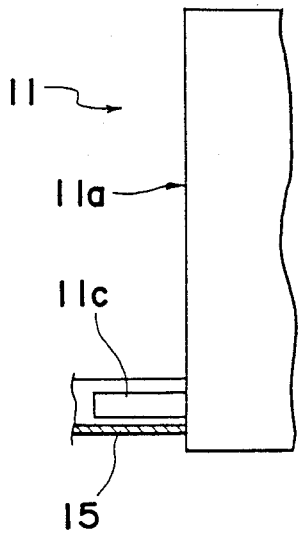
Figure 1C:
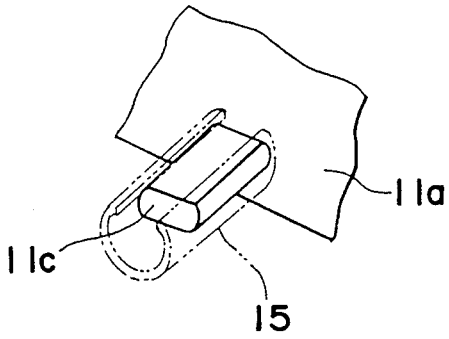

In the above construction, the waste toner collecting container 11 equipped with the corona charger, and directly related to the present invention generally includes as also shown in FIG. 1(*a*), a waste toner collecting box 11*a* extending over a length approximately the same as a lateral width of the photoreceptor drum 10 and having a generally U-shaped cross section so as to be open at its side 11*j* confronting the photosensitive surface 10*a* of the phtoreceptor drum 10, a charger case 11*b* in a cubic box-like configuration, attached adjacent to the open side 11*j* of the waste toner collecting box 11*a* and similarly open at its side facing the photosensitive surface of the photoreceptor drum 10, and a corona charger line 11*g* disposed within said charger case 11*b*.

It should be noted here that the charger case 11*b* referred to above may be integrally formed with the waste toner collecting box 11*a*, or separately attached to said waste toner collecting box 11*a* as in the above embodiment Within the waste toner collecting box ll*a*, there. is provided a cleaning blade 11*f* held between a partition wall 11*r* and a holding member 11*d* fixed to an upper wall of said collecting box 11*a* so as to be in contact, at its forward edge, with the surface 10*a* of the photoreceptor drum 10, while a waste toner inducing vane 11*e* for transporting the waste toner is rotatably provided in the vicinity of the cleaning blade 11*f* for introducing the waste toner scraped off the photosensitive surface 10*a* by the blade 11*f* into said collecting box 11*a*. As shown in FIG. 1(*b*) also, in positions close to rear lower corners of the collecting box 11*a*, fitting portions 11*c* each having generally a rectangular cross section are provided to extend outwardly from opposite side walls of said collecting box 11*a* so as to detachably mount the waste toner collecting container 11 equipped with the corona charger in the housing 26 by fitting said fitting portions 11*c* with support members 15 provided in corresponding positions on the side walls within said housing 26. Each of the support members 15 laterally extending from the side walls of the housing 26 has a circular cross section open at an upper portion, and after inserting the respective fitting portions 11*c* of the collecting box 11*a* into the support members 15 vertically in a longitudinal direction through the upper opening of said support members 15, the collecting box 11*a* is rotated to bring the fitting portions 11*c* thereof into the state as shown in FIG. 1(*c*) for fixing of said collecting box 11*a* in the housing 26.

Referring back to FIG. 2, within the housing 26 of the laser printer, in the feeding direction of the paper sheets with respect to the photoreceptor drum 10, a set of heat rollers 16 are disposed for functioning as a fixing device for heating and fixing the toner image transferred onto the paper sheet from the photoreceptor drum 10, a roller 17 which constitutes a set of discharge rollers together with the roller 4 of the paper feeding cassette 1 in the state where said cassette 1 is mounted, a transport passage changing 23 which forms part of a paper transport passage 25 by conformed to the guide wall member 2 of the cassette 1 through a predetermined interval and another discharge roller 18 disposed at the face-down paper receiving port 19*a* for the face-down tray 19.

By the above arrangement, during the printing function, as the photosensitive surface 10*a* of the photoreceptor drum 10 faces the charger case 11*b* of the waste toner collecting container 11 while the photoreceptor drum 10 rotates, corona discharge is produced through application of high voltage to the charger line 11*g*, thereby to charge the surface 10*a* of the photoreceptor drum 10. Subsequently, the laser light emitted from the semi-conductor laser unit 12 as indicated by the dotted chain line in FIG. 2 is projected onto the surface 10*a* of the photoreceptor drum 10 through the mirror 3, and only the portion of the surface 10*a* thus exposed to the laser light is erased so as to form the eloctrostatic latent image, which is developed into the visible image through adhesion of toner thereto as it confronts the developing unit 13.

On the other hand, the paper sheet is fed into the transport passage 25 from the manual paper feeding section 21 through the paper feeding roller 20 or from the paper feeding cassette 1 through the rollers 5 and 6, and thereafter, transported towards the photoreceptor drum 10 by the transport rollers 7, 8 and 9. Thus, the toner image formed on the photoreceptor drum 10 is transferred onto the paper sheet by the transfer charger 14, and the toner image thus transferred is heated and fixed onto the paper sheet by the heat roller 16. Subsequently, the paper sheet is discharged by the rollers 4 and 17 and the transport passage changing member 23, into the discharge port 22 or into the face-down tray 19 from the face-down paper receiving port 19*a* via the discharge roller 18.

At the photoreceptor drum 10, the residual toner still adhering to the photosensitive surface 10*a* after transfer of the toner image is scraped off by the cleaning blade 11*f*, and subsequently, accommodated into the waste toner collecting box 11*a* as the inducing vane 11*e* rotates.

When the interior of the collecting box 11*a* has been filled up with the waste toner, the waste toner collecting box 11*a* provided with the corona charger is rotated about the support members 15 in a direction indicated by an arrow A in FIG. 1(*a*) to disengage the fitting portions 11*c* of the collecting box 11*a* from the support members 15 for replacement of the collecting box 11*a*. In this case, the charger case 11*b* attached to the collecting box 11*a* is also to be exchanged, and the possibility of irregularity or variation in the charger output with respect to the photoreceptor drum 10 due to adhesion of scattering toner in air to the charger line 11*g* may be removed. Therefore, it becomes unnecessary to periodically clean the charger line by an exclusive cleaning item. Consequently the possibility of giving rise to such troubles as breakage or deformation of the charge line during cleaning, etc. may be advantageously eliminated.

As is clear from the foregoing description, the waste toner collecting container provided with the corona charger according to the present invention is so arranged that the corona charger for charging the photosensitive member after charge erasing is provided on the waste toner collecting box for accommodating toner scraped off the photosensitive surface after transfer.

By the above arrangement of the present invention, not only the necessity for cleaning the charger line of the corona charger is eliminated, but the possibility of such troubles as breakage or deformation, etc. of the charger line during cleaning is also removed.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. A waste toner collecting container for use in an electrophotographic arrangement having a photosensitive member, said waste toner collecting container comprising a disposable, one-piece, unitary container divided into a waste toner collecting box and a charger case, said charger case having a corona charge line for charging a photosensitive surface of the photosensitive member and aid waste toner collecting box receiving residual toner scraped off a photosensitive surface of a photosensitive member, said one-piece container with the waste toner collecting box and the charger case being readily removable from the electrophotographic arrangement and being replaceable with a new one-piece container after use thereof whereby cleaning of the corona charger line is avoided, said waste toner collecting container having fitting portions extending outwardly from rear lower portions of opposite side walls of the waste toner collecting box, said fitting portions being detachably mounted in a corresponding support member provided at a side of the electrophotographic arrangement when said one-piece container is received in the electrophotographic arrangement.

2. The waste toner collecting container as recited in claim 1, wherein the photosensitive member is a photoreceptor drum and wherein the waste toner collecting box extends a length generally the same as a lateral width of the photorecepter drum, said waste toner collecting box being open at a side confronting the photosensitive surface of the photoreceptor drum and said charger case being provided adjacent to the open side of the waste toner collecting box and being open at a side thereof confronting the photosensitive surface of the photoreceptor drum.

3. The waste toner collecting container as recited in claim 2, further comprising a cleaning blade provided in the waste toner collecting box, a forward edge of the blade being held in contact with the photosensitive surface of the photoreceptor drum and comprising a waste toner inducing vane rotatably provided int he vicinity of the cleaning blade for transporting waste toner scraped off the photosensitive surface into the waste toner collecting box.

4. The waste toner collecting container as recited in claim 3, wherein the waste toner inducing vane is positioned within the waste toner collecting box, the cleaning blade is positioned between the charge case and the waste toner inducing vane, the charger case being formed, in part, by a partition wall and the collecting box having a holding member affixed to an upper wall thereof, and the partition wall and holding member mounting the cleaning blade in position.

5. The waste toner collecting container as recited in claim 4, wherein the one-piece container of the waste toner collecting box and the charger case is generally free of interior structure except for the waste toner inducing vane, the holding member, the cleaning blade, the partition wall and the corona charger line.

6. The waste toner collecting container as recited in claim 1, wherein the one-piece container is positionable adjacent the photosensitive member and the one-piece container is removable from the electrophotographic arrangement while the photosensitive member remains within the electrophotographic arrangement.

* * * * *